US006422158B1

(12) United States Patent
Fitts, Sr. et al.

(10) Patent No.: US 6,422,158 B1
(45) **Date of Patent: *Jul. 23, 2002**

(54) AUTOMATIC TELLER MACHINE TRANSPORT SYSTEM

(75) Inventors: John E Fitts, Sr., Gaston; Kenneth G Senterfeit, Sr., West Columbia, both of SC (US)

(73) Assignee: Concept Unlimited Inc, Gaston, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/599,292

(22) Filed: Jun. 21, 2000

Related U.S. Application Data

(63) Continuation-in-part of application No. 09/191,226, filed on Nov. 13, 1998, now abandoned, which is a continuation-in-part of application No. 08/887,012, filed on Jul. 2, 1997, now Pat. No. 5,836,256.

(51) Int. Cl.[7] ..... E05G 1/00

(52) U.S. Cl. ..... 109/2; 109/24.1; 109/47; 902/34

(58) Field of Search ..... 109/2, 24.1, 45, 109/47, 48, 50, 58, 87; 902/30–35; 312/249.9, 334.24, 334.25, 334.27, 331, 350, 319.5, 319.7, 319.8

(56) References Cited

U.S. PATENT DOCUMENTS 4,399,755 A * 8/1983 Widemann ..... 109/2
4,497,261 A * 2/1985 Ferris et al. ..... 109/2
4,557,352 A * 12/1985 Tschappat, Jr. ..... 109/2 X
4,558,650 A * 12/1985 Berman ..... 109/24.1
4,577,562 A * 3/1986 Berman ..... 109/24.1
4,603,643 A * 8/1986 Couvrette ..... 109/2 X
4,856,437 A * 8/1989 Trucksess ..... 109/24.1
5,036,779 A * 8/1991 Capraro ..... 109/2 X
5,379,704 A * 1/1995 Couvrette ..... 109/2 X
5,440,999 A * 8/1995 Dallman et al. ..... 109/2 X
5,615,623 A * 4/1997 Capraro, Jr. ..... 109/2
5,711,231 A * 1/1998 Couvrette et al. ..... 109/2
5,836,256 A * 11/1998 Senterfeit, Sr. ..... 109/2 X

* cited by examiner

*Primary Examiner*—Suzanne Dino Barrett
(74) *Attorney, Agent, or Firm*—Michael A Mann; Nexsen Pruet Jacobs & Pollard LLC

(57) ABSTRACT

Apparatus is disclosed for moving an automatic teller machine and the like between an operational position and a servicing position to provide access to the back of the machine for servicing. The apparatus essentially comprises a stationary frame and a moving carriage supported by the frame. In the operational position, the front end of the carriage is coextensive with the front end of the frame. In the servicing position, however, the front end of the carriage is cantilevered beyond the front end of the frame. The carriage may also be telescopic such that a telescoping member is contained in the carriage to allow the carriage more movement. In order to move and support the carriage, especially in the servicing position, there is a shaft freely rotatable in a pair of bearings at the front end of the frame on which the carriage rides. The back end of the carriage rides within the frame's rails, which prevent the carriage from moving up or down but otherwise freely allow lateral movement. By turning the shaft, with a hand crank or a small motor, the carriage with the teller machine can easily be moved between operational to servicing positions. An ATM housing shaped like a cabinet is also disclosed that contains a door in the back for servicing the ATM. When the ATM is housed in a cabinet, the whole cabinet moves between the servicing and operational position.

19 Claims, 10 Drawing Sheets

100
102
104
106
108
12
10
84
4
2

20
42
22
40
94
98
96
94

54
40
22
34
62
42
32
64
30

AUTOMATIC TELLER MACHINE TRANSPORT SYSTEM

The present application is a continuation in part of application Ser. No. 09/191,226, filed Nov. 13, 1998 and now abandoned, which is a continuation in part of U.S. Ser. No. 08/887,012 filed Jul. 2, 1997, now U.S. Pat. No. 5,836,256.

FIELD OF THE INVENTION

The present invention relates generally to the moving of automatic teller machines (ATMs) between operational positions and servicing positions for servicing. In particular, the present invention relates to moving an ATM located on an island in a drive-through bank lane between operational and servicing positions.

DISCUSSION OF BACKGROUND

Automatic teller machines (ATMs) and, more recently, automatic loan machines (ALMs), have made it more convenient for consumers to take care of their routine banking needs. ATMs are frequently housed in small buildings, or "kiosks" on concrete "islands" between lanes of a drive-through bank. Consumers may obtain cash, make deposits, check on balances, obtain consumer loans, etc., by simply driving up to the ATM from the appropriate lane and accessing its control panel.

These ATMs must be serviced periodically by reloading them with cash, retrieving the deposits, changing printer ribbons, and performing routine maintenance and repair. However, the nature of kiosks and orientation of the ATM in relation to the kiosk complicates servicing. The kiosks are narrow and relatively small buildings. Because servicing of the ATM is done from inside the kiosk, the formalities associated with construction of any occupied or building apply to kiosks, such as windloading standards, occupancy standards, building permits and installation of air conditioning.

Furthermore, servicing of ATMs is done from the back. Because the kiosks housing the ATMs are narrow, to occupy as narrow a drive-through island as possible, there would be insufficient space behind the ATM in the kiosk for servicing unless (1) the ATM were rotated so that its back is oriented to the side; (2) the ATM could be pushed out of the kiosk into the drive-through lane to provide room behind it in the kiosk; or (3) the back of the kiosk opened up to allow access to the ATM from the next lane. This last alternative is generally unacceptable because it puts two lanes of a drive through bank out of service: the lane where the ATM is accessed, and the next lane where the servicing employee is standing.

ATM rotation systems are often somewhat complicated so "push out" systems are preferred. Consequently, a number of systems have been designed to move the ATM between a operational position inside a kiosk and a servicing position pushed out of a kiosk. These are generally referred to as transport systems.

For example, the transport systems described by Dallman et al. in U.S. Pat. No. 5,440,999 include several approaches to moving an ATM between servicing and operational positions, including two designs based on the use of cables. The cable systems are complicated and involve multiple cables and pulleys and air or hydraulic cylinders. Another of the designs uses a rack and pinion arrangement.

In the designs of ATM transport systems there is usually a bearing that allows movement between a base and a carriage that supports the ATM. The base remains stationary and the carriage moves between the operational position and servicing position. Additionally, there is a device that causes the movement of the carriage with respect to the base.

An effective ATM transport system would move the ATM simply, reliably and inexpensively between the operational and servicing positions on as narrow a drive-through island as possible, yet providing sufficient room behind the ATM to allow access by an employee standing on the island.

SUMMARY OF THE INVENTION

According to its major aspects and broadly stated, the present invention is an apparatus for moving an automatic teller machine (ATM) and the like between a operational position and a servicing position. The apparatus in its essential embodiment comprises a stationary frame and a moving carriage supported by the frame. In the operational position, the front end of the carriage is coextensive with the front end of the frame and both are inside the kiosk. In the servicing position, however, the front end of the carriage is cantilevered beyond the front end of the frame. In order to move and support the carriage, especially in the servicing position, there is a shaft held by bearings attached to the front end of the frame. The shaft rotates freely in the bearings and the carriage rides directly on the shaft. The back end of the carriage rides within the frame's rails to prevent the carriage from moving up or down but otherwise freely allows lateral movement. By turning the shaft with a hand crank or a small motor, the carriage with the teller machine resting on it can easily be moved between operational and servicing positions.

In alternative embodiments, the ATM transport system includes the ATM housing, which is also transported between servicing and operational positions along with the ATM. The housing has a door located on its back so that the ATM can be accessed by someone standing on the island to which the frame is secured and who obtains access by opening the door of the housing.

In another alternative embodiment, additional space behind the ATM can be obtained by use of telescoping carriage.

An advantage of the present invention is its simplicity. The ATM can be moved easily using a simple handcrank. Therefore, there are no sprockets, no pulleys, no chains, and no complicated arrangements of moving parts to require service and repair. Furthermore, in the event of an electricity failure, the ATM can still be serviced or retracted into the kiosk. Because ATMs are serviced daily and have useful lives that span several years, reliability of operation of the ATM transport system is an important consideration.

An important feature of the present invention is the rotating shaft. Not only does it support the ATM, via the carriage, but the shaft moves it between the servicing position and operational position. The use of a simple, sturdy shaft to roll the ATM between its extreme positions greatly simplifies the design by combining support and moving mechanisms in one structure.

Extending the housing along with the ATM is another feature of the present invention. By making the housing extend along with the ATM, it no longer needs to be a "building" from a building codes standpoint because no one needs to enter it. Therefore, it no longer needs to meet a number of requirements that increase costs.

Use of a telescoping carriage makes it possible to provide additional space behind the ATM for servicing, making it possible to have slimmer ATM housings and kiosks on narrower islands, making better use of bank property.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

The present invention includes a device for moving an automatic teller machine (ATM) between an operational and a servicing position and a cabinet housing for an ATM. What is meant by the operational and servicing positions depends on the housing of the ATM. The housing of the ATM may be a kiosk, building, cabinet, or any other structure suitable for enclosing the ATM. If the ATM is housed in kiosk-type structure, the ATM will be in the operational position when the ATM is facing the driver in a drive through bank lane and in the servicing or extended position when it is either carried through a hole in the kiosk to an extended position or rotated so that the ATM is facing parallel to the drive through lane; however, with a cabinet-type housing, the entire cabinet is moved out over the ATM drive-through lane or rotated ninety degrees from its operational position.

Figure 1:
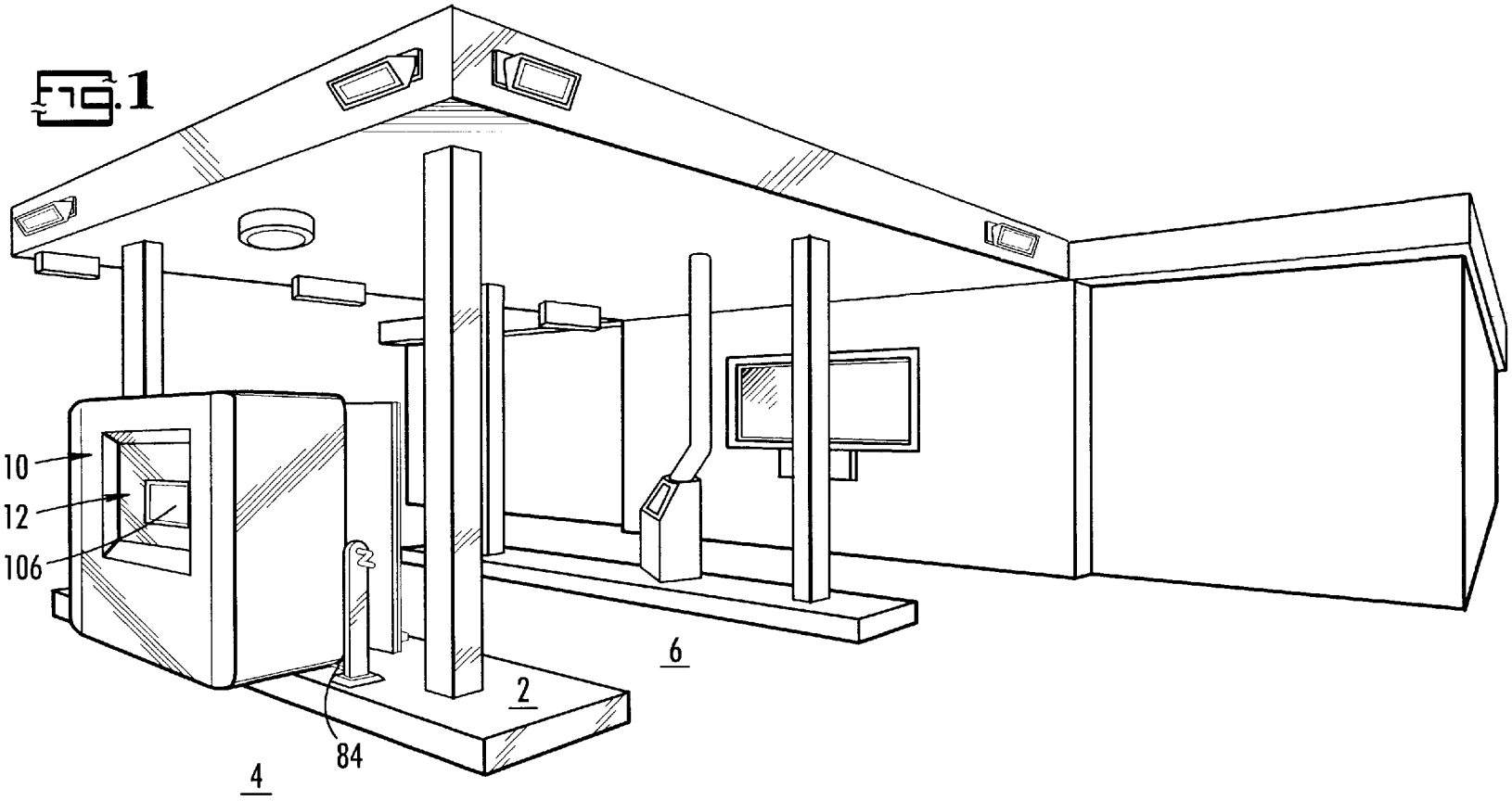
FIG. 1 is a perspective view of a drive-through bank having an ATM housed in a cabinet according to a preferred embodiment of the present invention.
Figures 2A, 2B:
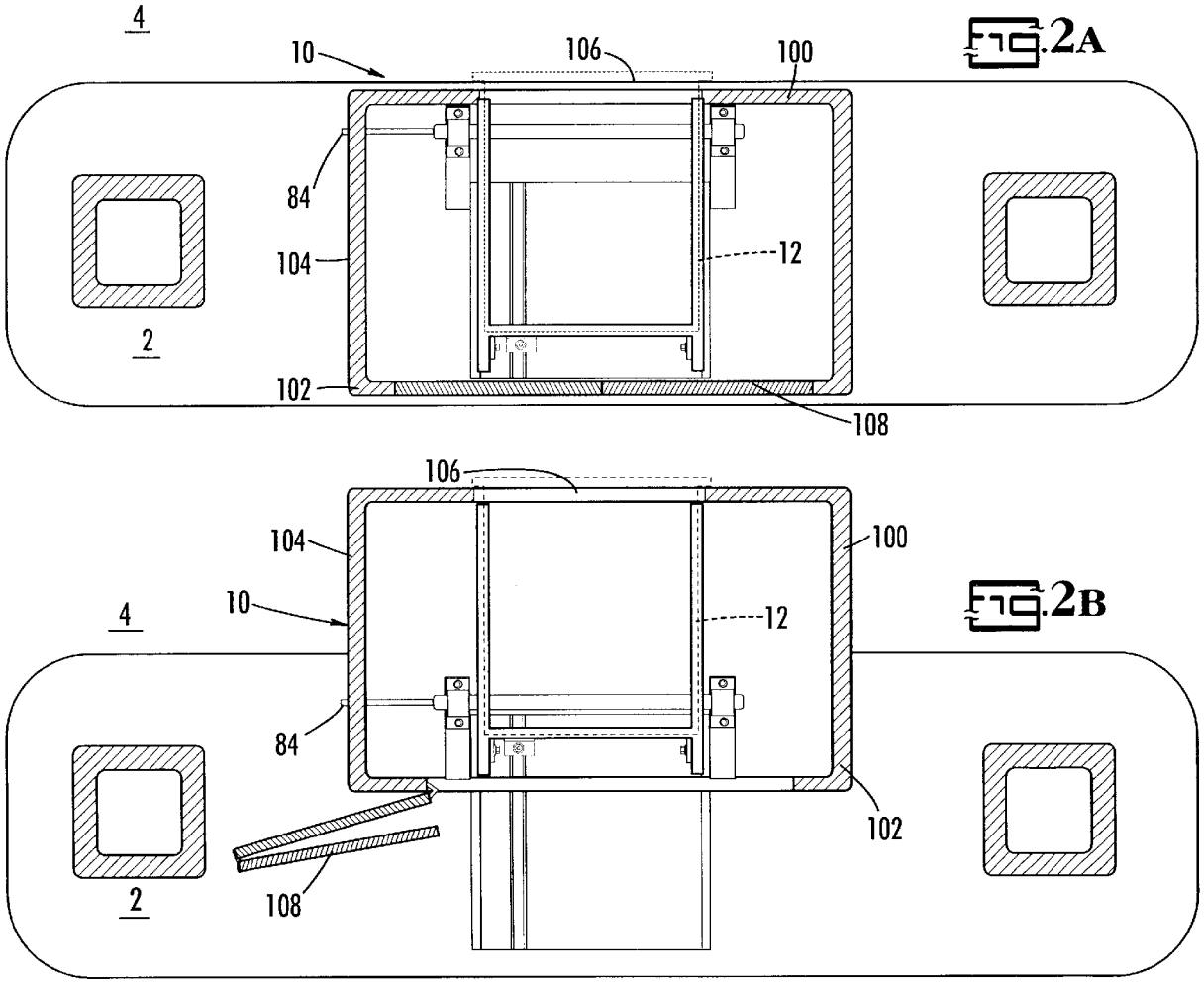
FIGS. 2A and 2B illustrate top views of ATM transport systems with the ATM in the operational and servicing positions respectively.

A moving apparatus should be able to move the ATM 12 from its operational position as shown in FIG. 2A to its servicing position as shown in FIG. 2B for any type of housing, whether it be of the kiosk or cabinet type. One embodiment of such a moving device is found in FIGS. 4A–6. Using this device the ATM 12 is cantilevered from island 2 into the ATM drive lane 4 so that an attendant can gain access to the back of ATM 12 to service it. This apparatus includes a stationary frame 20 and a movable carriage 22. For purposes of explaining this embodiment, the front ends of the frame 20 and carriage 22 are located on the same side as the front end 74 of ATM 12. Frame 20 is fixed with respect to the floor 24 of housing 10; carriage 22 rests on top of frame 20 and is supported by it in both the operational position and servicing position, where carriage 22 is cantilevered over the ATM drive through lane 4. By cantilevering, it is meant that neither ATM 12 nor the front end of carriage 22 on which ATM 12 rides touch the surface of ATM drive through lane 4 but are held above it by the support and securement provided by the back of carriage.

In the operational position (FIG. 4A), the front ends of carriage 22 and frame 20 are coextensive, that is, the front end of carriage 22 is located approximately overhead of the front end of frame 20, both being just inside wall of cabinet 10. In other words, coextensive means that the front end of the carriage 22 does not extend significantly farther forward, if at all, beyond the front end of frame 20. In the servicing position (FIG. 4B), the front end of carriage 22 has moved forward over the ATM drive through lane 4 and the back end of carriage 22 has moved forward toward the front end of frame 20.

Figure 4A:
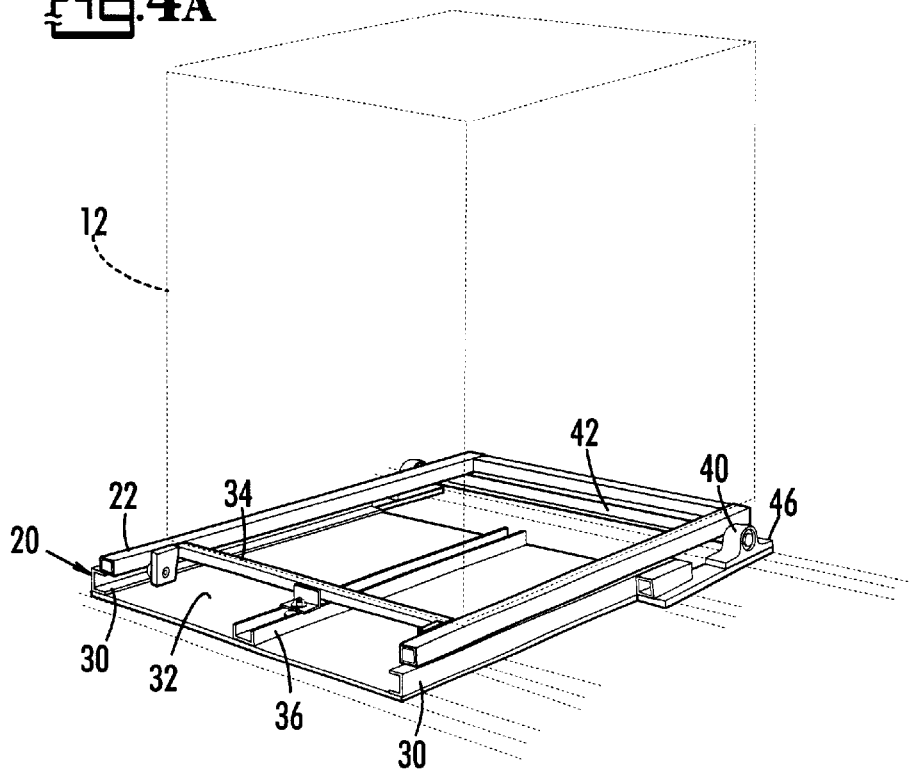
FIGS. 4A and 4B illustate a perspective view of an ATM transport system according to a preferred embodiment of the present invention in the operational and servicing positions, respectively.
Figure 4B:
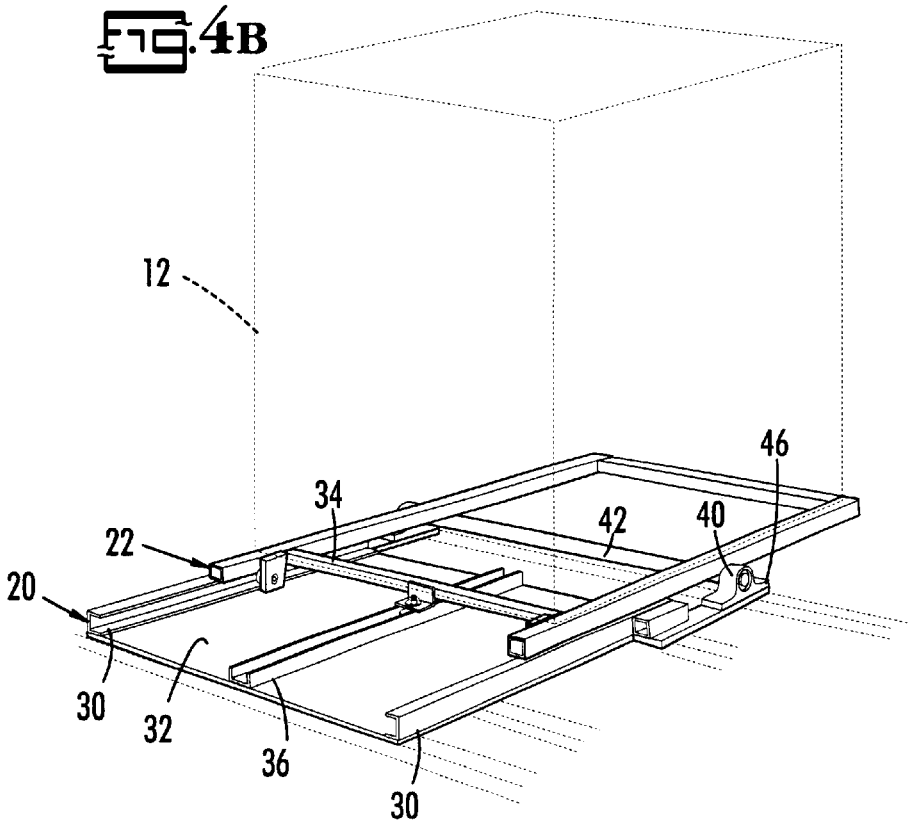
Figure 5:
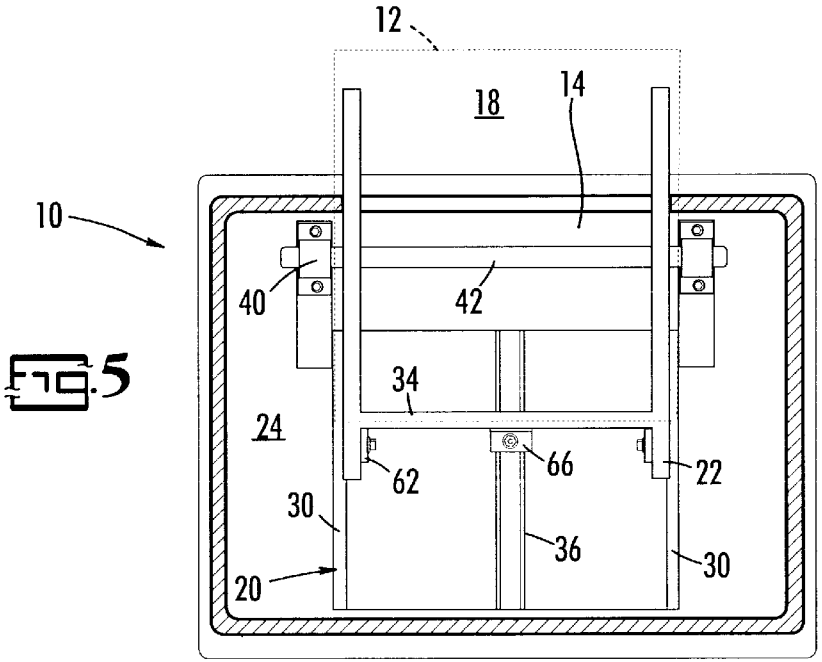
FIG. 5 is a top view of an ATM transport system according to a preferred embodiment of the present invention in the servicing position.
Figure 6:
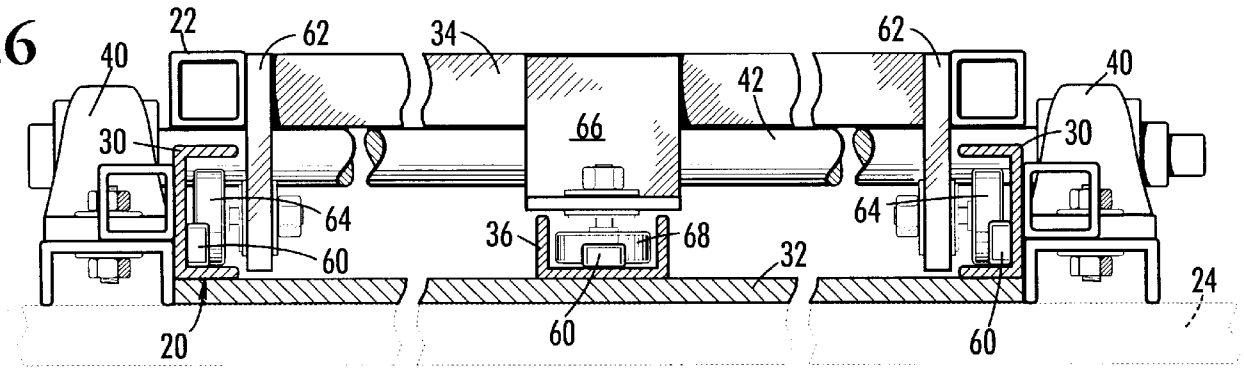
FIG. 6 is an end view of an ATM transport system according to preferred embodiment of the present invention.

Frame 20 comprises at least one rail and preferably at least two side rails 30, one on the left side of frame 20 and one on the right side of frame 30, as well as means for holding two side rails 30 parallel to each other. Side rails 30 may simply be fashioned from channel steel. As illustrated in FIGS. 4A, 4B, 6 a sheet 32 of steel can be used conveniently to hold side rails 30 in parallel relationship. Alternatively, side rails 30 can be set in cement or attached to a member 34 perpendicular to side rails 30.

Optionally, a central rail 36, also preferably made of channel steel, is provided for lateral stability in moving ATM 12 between operational and servicing positions. Central rail 36 is located between side rails 30 but not necessarily midway between them. Preferably, central rail 36 is located more toward one side rail 30, so that the area just above carriage 22 can be covered with a suitable flooring for the attendant servicing the ATM 12 to stand on.

Mounted toward the front end of frame 20 are bearings 40. A shaft 42 is journaled in bearings 40 so as to rotate freely therein. One end of shaft 42 is coupled to means for rotating the shaft. Two gears 94 are connected by an endless chain 96 and engaged by handle 98 such that turning the handle 98 rotates shaft 42. Alternatively instead of using a handle 98, the movement of gear and chain assembly could be effected by a motor 54. Regardless of whether the movement is accomplished manually or electrically, stops 60 (FIG. 6) limit the movement in each direction. If the movement is provided using an electric motor 54, stops 60 can be limit switches rather than interference stops that can be used to turn off motor 54 when carriage 22 has reached the end of its travel.

Carriage 22 rides on and is supported by frame 20. At its front end, carriage 22 is supported by resting on shaft 42. At its back end, it has two arms 62, one depending from each side and carrying a roller bearing 64. The location and disposition of arms 62 is such that each roller bearing 64 engages a side rail 30 in such a way that bearing 64 is prevented from vertical movement by side rail 30. Bearing 64's horizontal movement along rail 30 is not restricted other than by stops 60. Preferably, when side rails 30 are made of channel steel, the open side is to the side (outside or inside of frame 20) so that one side of the channel is up and one is down, like the letter "C". Roller bearings 64 ride inside the channel, engaging the sides of the channel above and below it, and arms 62 depend from carriage 22 on the open side of side rails 30.

Central rail 36 is oriented preferably with the open side facing up to receive an arm 66 and a roller bearing 68 from member 34. Any side-to-side motion of ATM 12 is limited by pressure of central rail 36 against bearing 68. Central rail 36, therefore, helps to maintain the alignment of both carriage 22 and ATM 12 as they move between operational and servicing positions.

When carriage 22 is in the operational position, the weight of an ATM 12 will cause roller bearings 64 to bear against the bottom of side rails 30; when in the servicing position, the weight of ATM 12 will cause roller bearings 64 to bear against the top of rails 30. Thus, bearings 64 cooperate with side rails 30 to secure the back end of carriage 22 to frame 20 whether it is in the servicing position or the operational position, but provide significant securement to hold carriage 22 down when carriage 22 and ATM 12 move to the servicing position where it is cantilevered over ATM drive-through area 4.

Figure 3A:
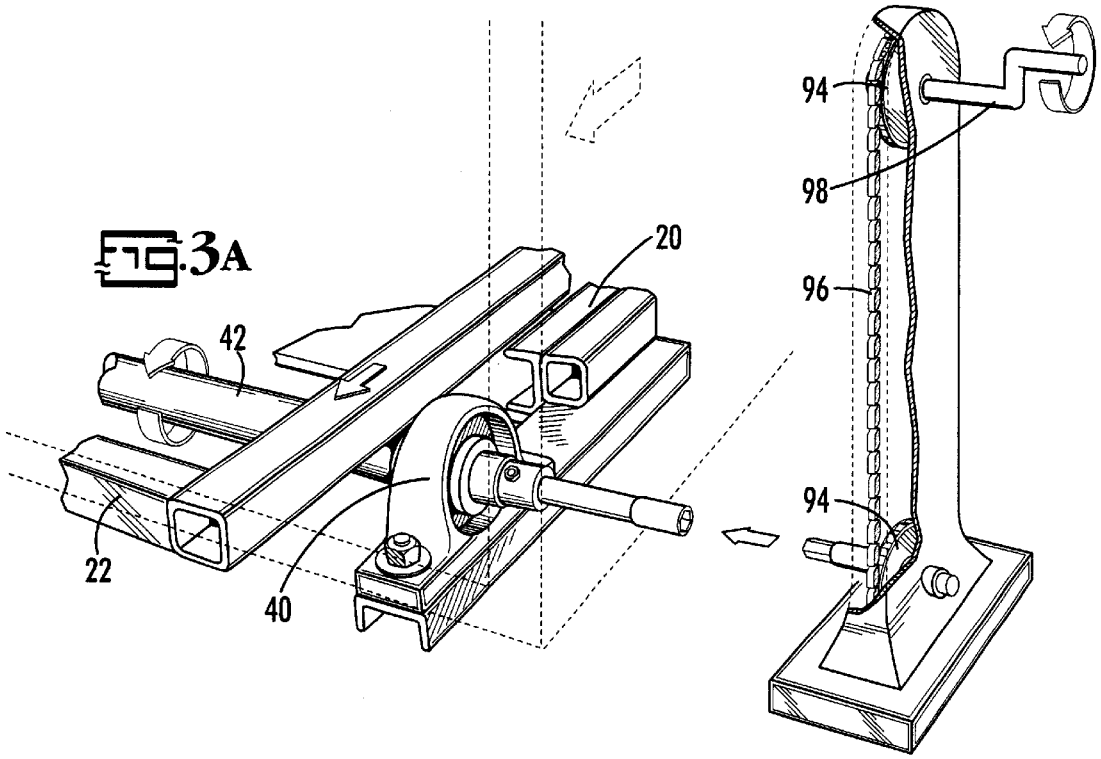
FIGS. 3A and 3B is a perspective, detailed view of a hand crank and used as an engagement device for a ATM transport system according to a preferred embodiment of the present invention.
Figure 3B:
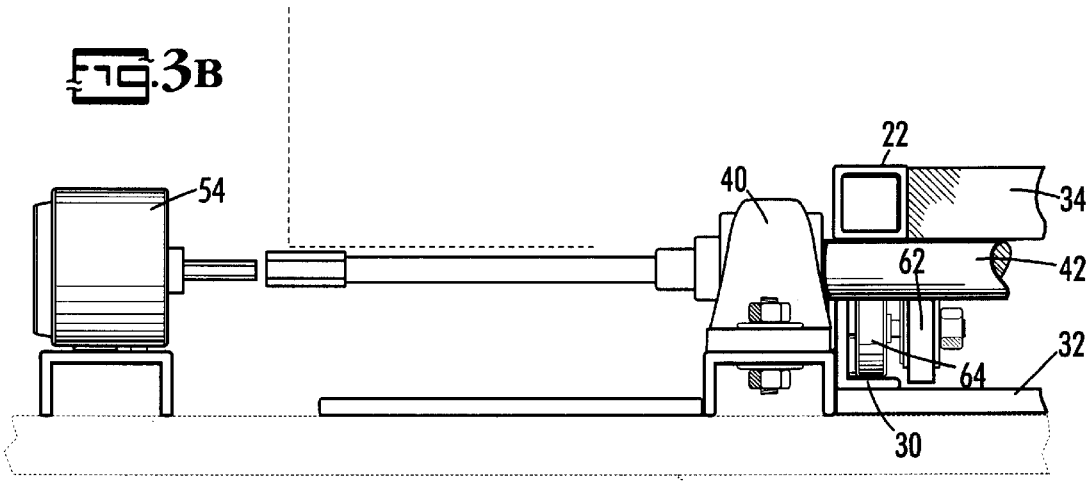

It will be clear that by simply rotating shaft 42 with ATM 12 on carriage 22, using manual or electric means, carriage 22 will move in the direction of rotation, as illustrated in FIG. 3A. The speed of rotation is arbitrary, and assuming frame 20 is level, the amount of force will depend primarily on the friction of bearings 40 and the diameter of shaft 42.

Another embodiment of an ATM moving apparatus is shown in FIGS. 7, 8, 9A, 9B, 9C, and 10. Using this device the ATM 12 is also cantilevered into the ATM drive lane 4 so that an attendant can gain access to the back of ATM 12 to service it without blocking a banking drive through lane 6. This apparatus includes a stationary frame 120 and a movable carriage 130. For purposes of explaining this embodiment, the front ends of the frame 120 and carriage 130 are located on the same side as the front end of housing 10. Frame 120 is fixed with respect to the floor of housing 10; carriage 130 rests on top of frame 120 and is supported by it in both the operational position and servicing position, where carriage 130 is cantilevered over the ATM drive through lane 4.

In the operational position (See FIG. 9A), the front ends of carriage 130 and frame 120 are coextensive, that is, the front end of carriage 130 is located approximately overhead of the front end of frame 120, both being just inside wall of housing 10. In the servicing position (See FIG. 9C), the front end of carriage 130 has moved forward over the ATM drive and the back end of carriage 130 has moved forward toward the front end of frame 120.

Figure 7:
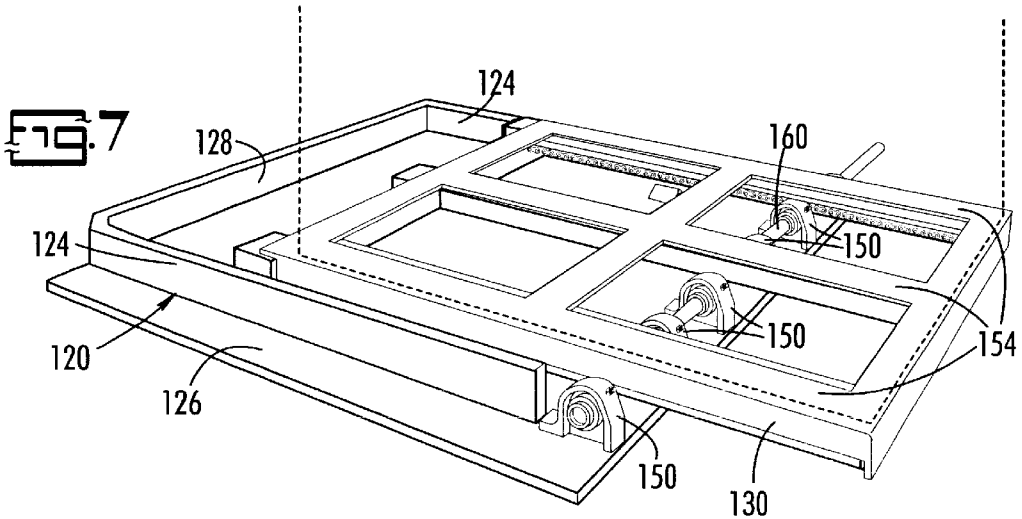
FIG. 7 is a perspective view of an ATM transport system according to a preferred embodiment of the present invention before the telescoping member is engaged.
Figure 8:
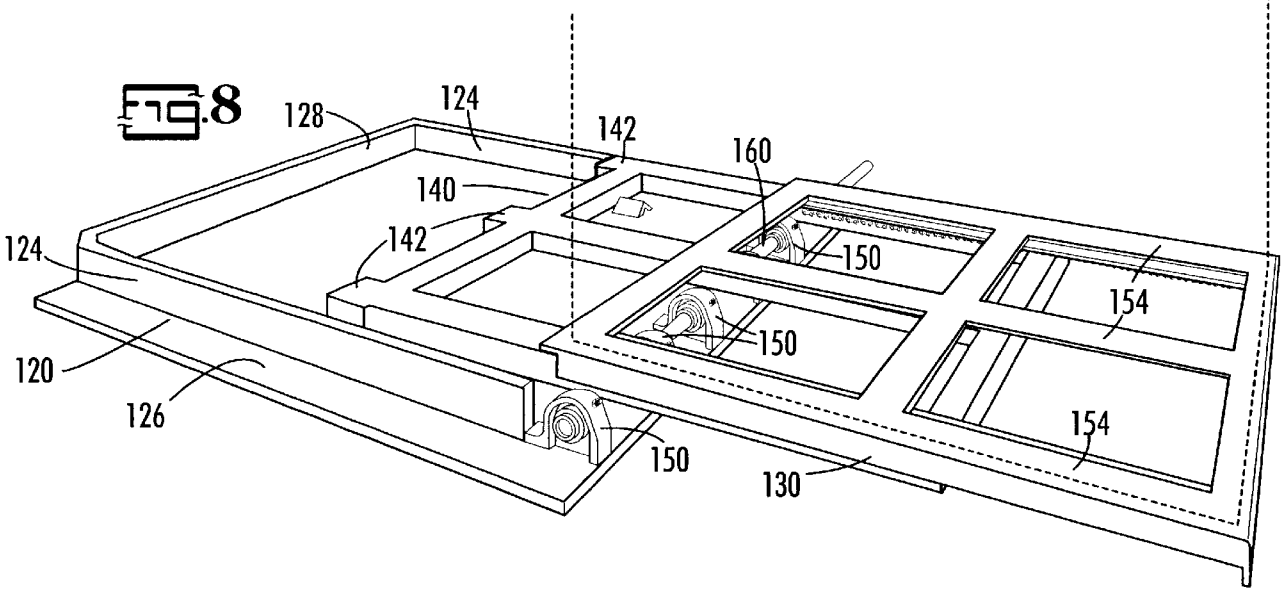
FIG. 8 is a perspective view of an ATM transport system according to a preferred embodiment of the present invention after the telescoping member has engaged.
Figure 9A:
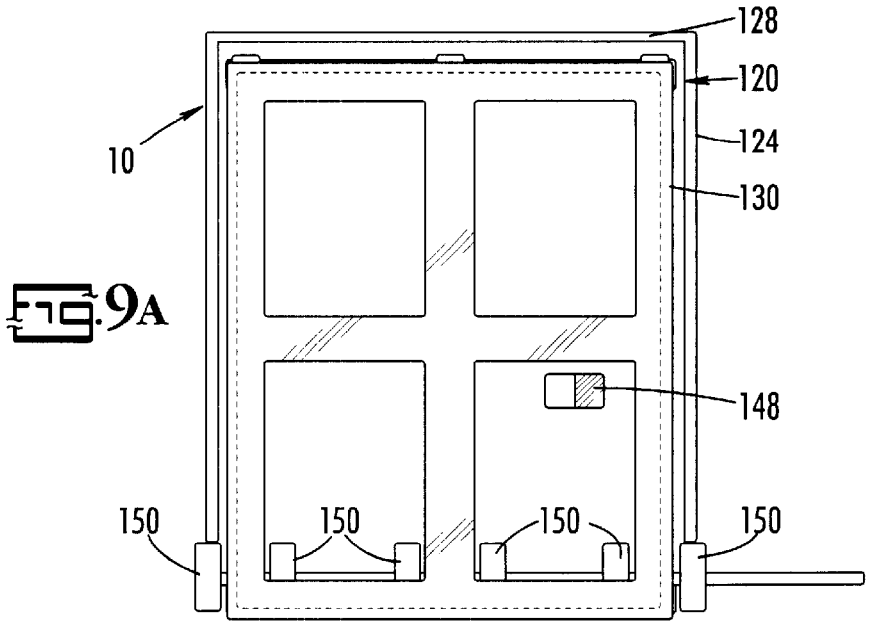
FIGS. 9A, 9B, and 9C illustrate top view of an ATM transport system according to a preferred embodiment of the present invention which is in an operational, partially servicing and fully servicing positions, respectively.
Figure 9B:
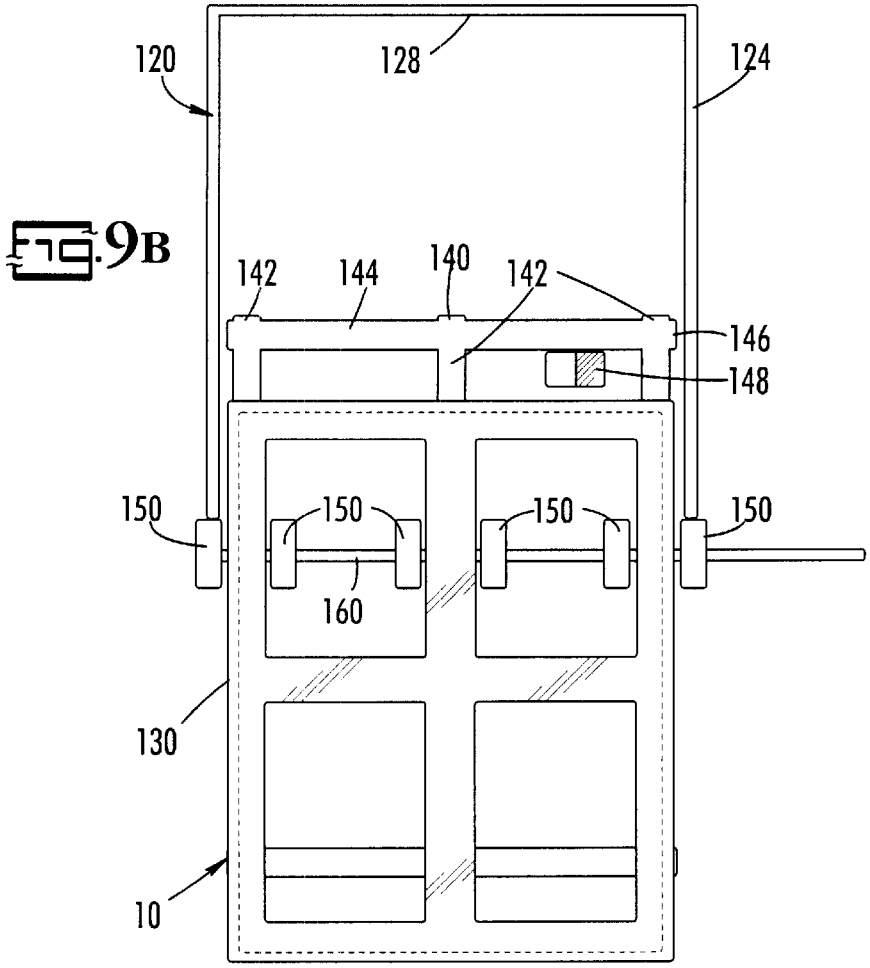
Figure 9C:
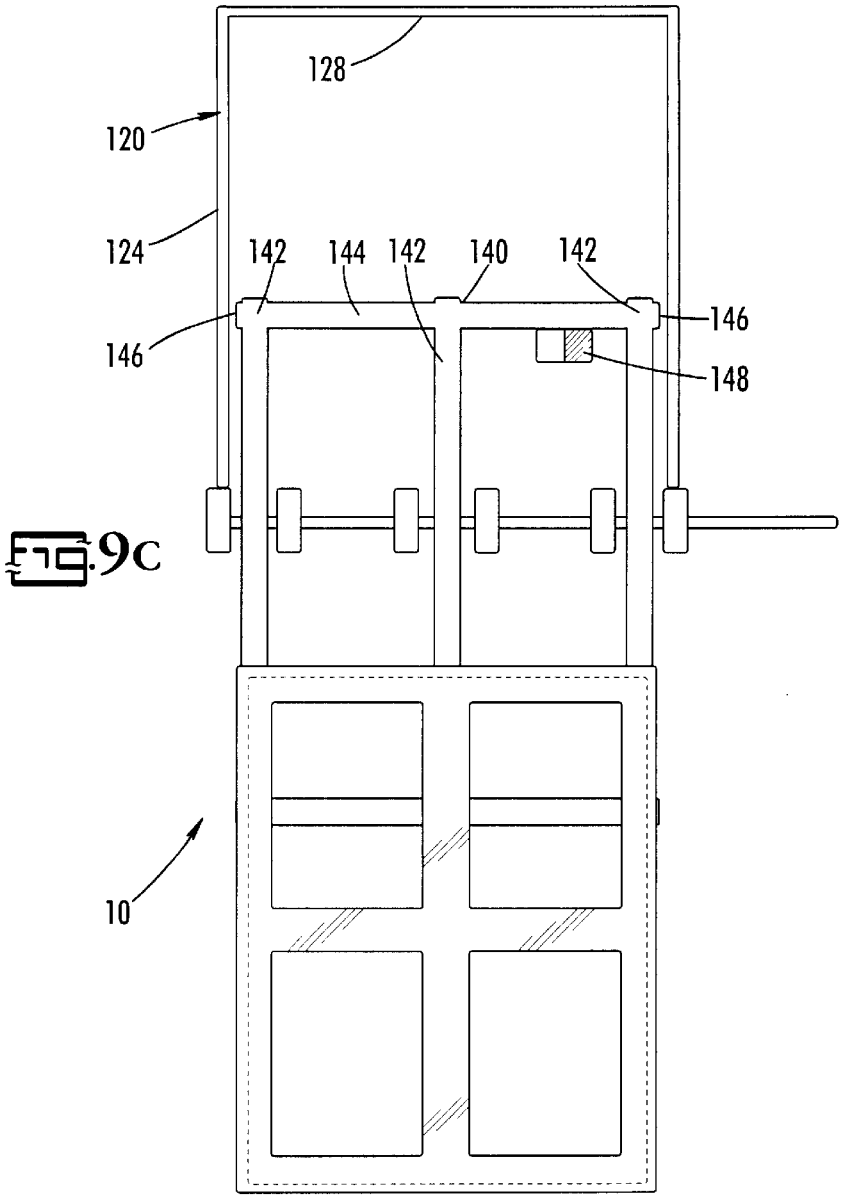
Figure 10:
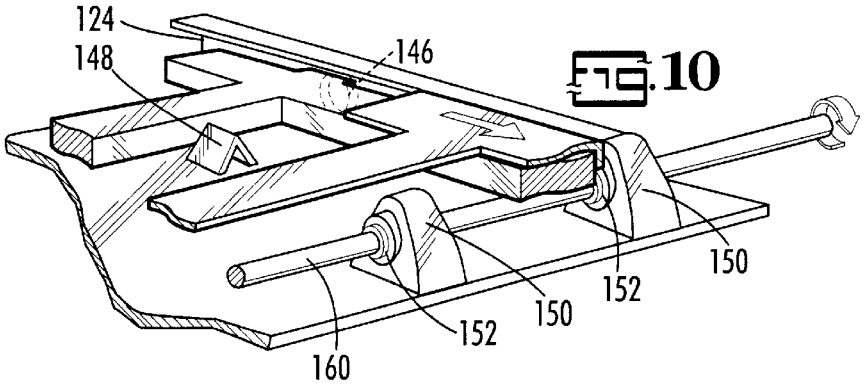
FIG. 10 is a cut away end view of an ATM transport system according to a preferred embodiment of the present invention.
Figure 11:
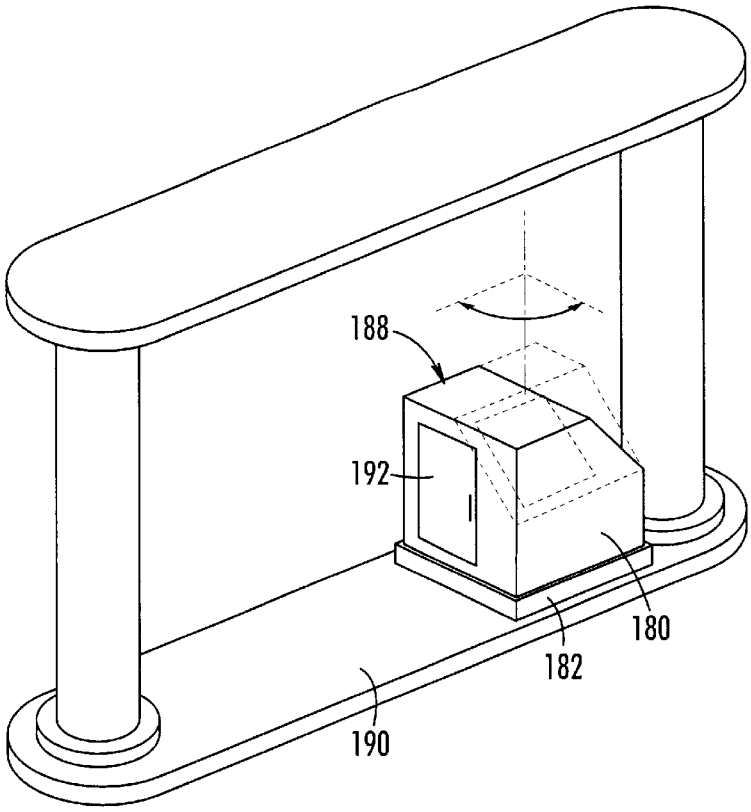
FIG. 11 is a perspective view of an ATM cabinet, according to an alternate, preferred embodiment of the present invention.
Figure 12:
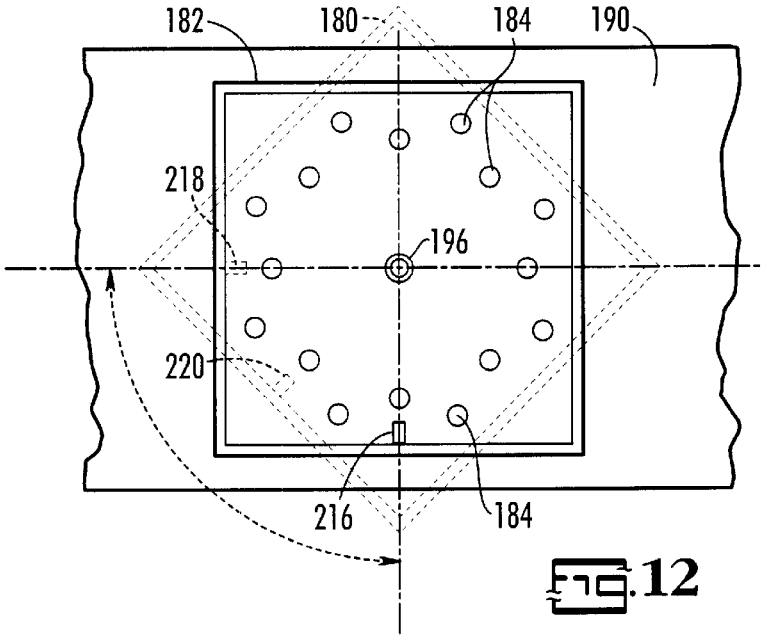
FIG. 12 is a top view of the ATM cabinet of FIG. 11, according to an alternate preferred embodiment of the present invention.
Figure 13:
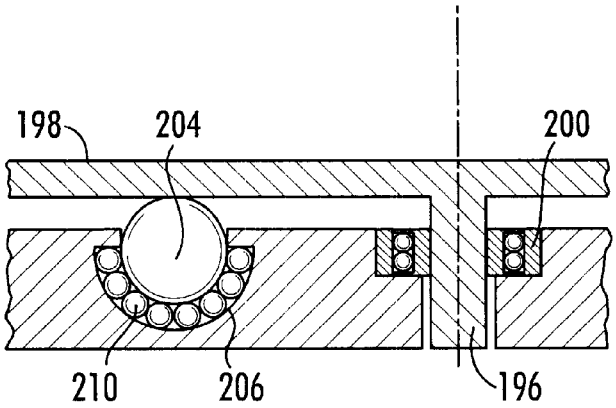
FIG. 13 is a detailed view of the bearings of the ATM cabinet of FIG. 11, according to the alternate preferred embodiment of the present invention.

Frame 120 comprises at least one rail and preferably at least two side rails 124, one on the left side of frame 120 and one on the right side of frame 120, as well as means for holding two side rails 124 parallel to each other. Side rails 124 may simply be fashioned from channel steel. As illustrated in FIGS. 7 and 8, a sheet 126 of steel can be used conveniently to hold side rails 124 in parallel relationship. Alternatively, side rails 124 can be set in cement or attached to a member 128 perpendicular to side rails 124.

Mounted toward the front end of frame 120 are at least two bearings, but preferably a series of bearings 150. A shaft 160 is journaled in bearings 150 so as to rotate freely therein. Connected on each side of the bearings is a flange 152 which hold beams 154 on the carriage 154 from moving laterally when the carriage 130 is moving between the operational and servicing positions. The bearings and flanges should be positioned on the shaft to allow for lateral stability of beams 154.

Carriage 130 rides on and is supported by frame 120. At its front end, carriage 130 is supported by resting on shaft 160. At its back end, the carriage 130 is supported by a telescoping member 140. Telescoping member 140 is of suitable size to slidably conform to beams 154 of carriage 130.

At the front of telescoping member 140, telescoping beams 142 are contained within carriage beams 154 in the operational position or partially contained within the carriage beams 154 in the servicing position. At the back end of telescoping member 140 is a cross beam 144 containing a roller bearing 146 on each side. The location and disposition of cross beam 144 is such that each roller bearing 146 engages a side rail 124 in such a way that bearing 146 is prevented from vertical movement by side rail 124. When carriage is in the operational position, the weight of an ATM 12 will cause roller bearings 146 to bear against the bottom of side rails 124; when in the servicing position, the weight of ATM 12 will cause roller bearings 146 to bear against the top of rails 124. Thus, bearings 150 cooperate with side rails 124 in conjunction with telescoping beams 142 to secure the back end of carriage 130 to frame 120 whether it is in the servicing position or the operational position, but provide significant securement to hold carriage 130 down when carriage 130 and ATM 12 move to the servicing position where it is cantilevered over ATM drive lane 4.

The telescoping member is engaged by cross beam 144's contact with stops 148 and operational by moving carriage beams 154 over telescoping beams 142 while telescoping member 140 is stopped by rear frame member 128. In operation moving to an servicing position, the telescoping member 140 is fully contained within the carriage beams 154 (See FIG. 9A) and does not telescope until the cross beam 144 comes into contact with the stops 148 (See FIG. 9B). Once the cross beam 144 contacts the stops 148, the telescoping member 140 remains stationary while the carriage 130 continues to extend (See FIG. 9C). In moving to an operational position, the telescoping member moves toward the back end of the frame and is stopped by making contact with the rear frame member 128. The carriage 130 continues to move toward the back end of the housing 10 such that it contains the telescoping member 140 and stops upon contacting the cross beam 144.

If more friction is needed to extend the ATM 12, several options are available. The shaft upon which the ATM rests could be coated with a abrasive material. Optionally, a set of chain and sprocket systems may work in conjunction with the shaft 160 to move the carriage 130 to its servicing and operational positions. For example, a chain attached by clamps to a mounting member located along each outside most carriage beams 154 and gripably fastened to a set of sprockets mounted on the shaft 160 could be driven by set of sprockets are mounted on the shaft 160 such that the sprockets rotate in accordance with the shaft 160's rotation propelling the chains.

Referring now to FIGS. 2A and 2B, the present invention includes a cabinet 10 for housing an automatic teller machine (ATM) 12 that may be used in conjunction with an apparatus for moving the cabinet 10 between its operational position and servicing position. The cabinet 10 contains a front end 100, back end 102, and sides 104 which are of suitable sizes to fully enclose an ATM 12 inside the cabinet 10. The front end 100 is the side from which traffic approaches to make use of the ATM 12, the same side as ATM drive-through lane 4. The front end 100 contains an opening 106 for the ATM 12 display and keypad to be seen and used. The ATM 12 is positioned such that the back end 102 is the side for servicing and may face a banking drive through lane 6. The back end 102 contains a door 108 that opens to provide access for servicing the ATM 12. In the preferred embodiment, the door 108 is a fan type door to allow the door to be folded and not block a banking drive through lane 6. One side of the cabinet 10 contains an engagement aperture 84 in which an external device could engage an apparatus for moving the cabinet 10 between its operational and servicing positions. In the preferred embodiment, a socket is contained in the engagement aperture 84 to engage a moving apparatus.

FIGS. 11–14 illustrate an ATM cabinet according to an alternate, preferred embodiment of the present invention. Cabinet 180 rests on a base 182 holding plural transfer bearings 184 that facilitate the rotation of cabinet 180 with respect to base 182 from an operational position wherein ATM 188 is facing the lane on the side of an "island" 190 of a drive-through bank (not shown) to a servicing position wherein ATM 188 is at right angles with respect to the operational position. In the servicing position, the back 192 of cabinet is accessible to someone standing on island 190 for servicing (adding cash, changing receipt tapes, etc.).

Rotation of cabinet 180 with respect to base 182 is about a shaft 196 (best seen in FIG. 13) extending downward from a carriage 198 into a recess 202 in base 182. Carriage 198 supports ATM 188. Shaft 196 is mounted in a bearing 200 to facilitate its rotation in recess 202. Transfer bearings 184, or any other suitable bearings, are carried by base 182 to support carriage 198 but allow it to rotate freely. Transfer bearings 184 are large ball bearings 204 in cups 206 formed in base 184 filled with smaller ball bearings 210.

Figure 14:
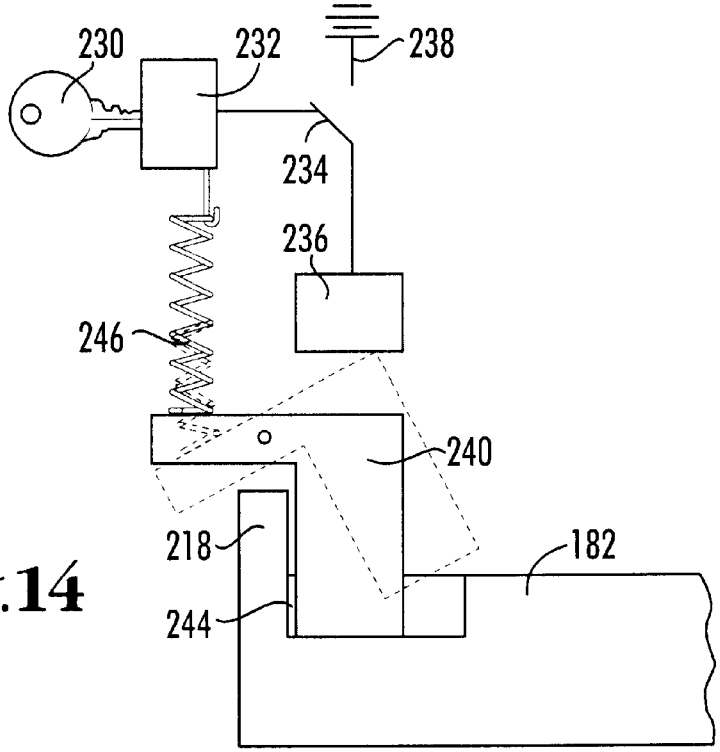
FIG. 14 is a detailed schematic illustration of a latching mechanism of the ATM cabinet of FIG. 11, according to the alternate preferred embodiment of the present invention.

To limit rotation of cabinet 180 to the range between the servicing and operational positions, stops 216 and 218 prevent over-rotation. A latch 220 stabilizes cabinet 180. Latch 220 can be selected from numerous types of latches that releasibly prevent movement of a rotatable body. In FIG. 14, a latch 220 based on use of an electromagnet is illustrated schematically. A key 230 turned in a lock 232 carried by cabinet 180 closes a switch 234. When switch 234 is closed, an electromagnet 236 is activated by power from a power source 238 such as a battery, as shown, and pulls a lever arm 240 free of a recess 244 in base 182. Lever arm 240 is biased by a spring 246 to the lowered position and does in fact lower lever arm 240 when switch 234 is opened. However, it will be clear to those familiar with simple mechanical, electrical and electromechanical latches that many other possible latches could be employed in the present invention to prevent the rotation of cabinet 180 once in either the operational or servicing positions.

It will be clear to those of ordinary skill in the art that many changes and substitutions can be made to the preferred embodiments described above without departing from the spirit and scope of the present invention, which is defined by the appended claims.

What is claimed is:

1. An apparatus for use with an automatic teller machine, said apparatus comprising:

a base;

a carriage adapted to hold an automatic teller machine;

a housing dimensioned to enclose said automatic teller machine; and bearing means for securing said carriage and said housing to said base and for moving said carriage and said housing with respect to said base between an operational position and a servicing position, said carriage and said housing being cantilevered from said base by said bearing means when in said servicing position, wherein said bearing means further comprises a shaft on which said carriage and said housing are rolled to move said carriage and said housing between said operational position and said servicing position.

2. The apparatus as recited in claim 1, wherein said bearing means further comprises a first bearing that supports said carriage when said carriage is in said operational and said servicing positions, and a second bearing that supports said carriage and said housing when said carriage is in said operational position and secures said carriage and said housing to said base when said carriage is cantilevered from said base in said servicing position.

3. The apparatus as recited in claim 1, wherein said base has a first end and an opposing second end, and wherein said bearing means further comprises bearings attached to said base and a shaft journaled in said bearings, said shaft moving said carriage and said housing when rotated in said bearings.

4. The apparatus as recited in claim 3, wherein said carriage rotates with respect to said base between said operational and said servicing positions.

5. The apparatus as recited in claim 4, wherein said base carries bearings to facilitate rotation of said carriage with respect to said base.

6. The apparatus as recited in claim 1, wherein said base has a channel formed therein, said channel having a top and an opposing bottom, and wherein said bearing means further comprises bearings that run within said channel, engaging said top of said channel when said carriage is in said servicing position and engaging said bottom of said channel when in said operational position.

7. The apparatus as recited in claim 1, wherein said housing has a front and an opposing back, said back of said housing having a door that provides access to said automatic teller machine for servicing by a user from a position over said base.

8. The apparatus as recited in claim 1, wherein said carriage further comprises a first portion and a second portion received within said first portion, said second portion extending telescopingly from said first portion when said bearing means moves said carriage to said servicing position.

9. An apparatus for moving an automatic teller machine in a housing between a operational position and a servicing position, said housing having a hole formed therein for said automatic teller to pass therethrough when being moved between said operational position and said servicing position, said apparatus comprising:

a base;

a carriage adapted to hold an automatic teller machine; and bearing means for securing said carriage to said base and for moving said carriage with respect to said base between an operational position and a servicing position, said carriage being cantilevered from said base by said bearing means when in said servicing position.

10. The apparatus as recited in claim 9, wherein said carriage further comprises a first portion and a second portion received within said first portion, said second portion extending telescopingly from said first portion when said bearing means moves said carriage to said servicing position.

11. The apparatus as recited in claim 9, wherein said carriage further comprises:

a first portion;

a second portion received within said first portion, said second portion extending telescopingly from said first portion when said bearing means moves said carriage to said servicing position; and stops for stopping the movement of said first portion but not said second portion when said bearing means moves said carriage between said first position and said second position.

12. The apparatus as recited in claim 9, wherein said bearing means further comprises a shaft on which said is rolled to move said base between said operational position and said servicing position.

13. The apparatus as recited in claim 9, wherein said bearing means further comprises a first bearing that supports said carriage when said carriage is in said operational and said servicing positions, and a second bearing that supports said carriage when said carriage is in said operational position and secures said carriage to said base when said carriage is cantilevered from said base in said servicing position.

14. The apparatus as recited in claim 9, wherein said base has a first end and an opposing second end, and wherein said bearing means further comprises bearings attached to said base and a shaft journaled in said bearings, said shaft moving said carriage when rotated in said bearings.

15. The apparatus as recited in claim 14, further comprising means for rotating said shaft.

16. The apparatus as recited in claim 14, further comprising a hand crank for rotating said shaft.

17. The apparatus as recited in claim 9, wherein said base has a channel formed therein, said channel having a top and an opposing bottom, and wherein said bearing means further comprises bearings that run within said channel, engaging said top of said channel when said carriage is in said servicing position and engaging said bottom of said channel when in said operational position.

18. An apparatus for use on an island between two lanes of traffic at a drive-through bank, said apparatus comprising:

a base secured to an island of a drive-through bank;

a carriage movably secured to said base;

an automatic teller machine mounted to said carriage;

a housing enclosing said automatic teller machine, said housing having an access door;

means for moving said housing and said automatic teller machine between an operational position atop said island and a servicing position where said automatic teller machine and housing are cantilevered over a lane adjacent to said island.

19. The apparatus as recited in claim 18, wherein said carriage further comprises a first portion and a second portion received within said first portion, said second portion extending telescopingly from said first portion when said moving means moves said carriage to said servicing position.

* * * * *